US005161449A

United States Patent [19]

Everett, Jr.

[11] Patent Number: 5,161,449

[45] Date of Patent: Nov. 10, 1992

[54] PNEUMATIC ACTUATOR WITH HYDRAULIC CONTROL

[75] Inventor: Hobart R. Everett, Jr., San Diego, Calif.

[73] Assignee: The United States of America as represented by the Secretary of the Navy, Washington, D.C.

[21] Appl. No.: 719,436

[22] Filed: Jun. 24, 1991

Related U.S. Application Data

[62] Division of Ser. No. 456,023, Dec. 22, 1989, Pat. No. 5,058,385.

[51] Int. Cl.[5] ..... F15B 15/26

[52] U.S. Cl. ..... 91/42; 91/44; 92/8; 60/562; 60/581; 60/591

[58] Field of Search ..... 91/41, 42, 44, 459, 91/361, 275; 92/8, 9, 111; 60/562, 571, 572, 581, 591

[56] References Cited

U.S. PATENT DOCUMENTS

| | | | |
|---|---|---|---|
| 2,715,389 | 8/1955 | Johnson | 92/9 |
| 3,064,514 | 11/1962 | Wilson | 92/9 |
| 3,176,801 | 4/1965 | Huff | 92/9 |
| 3,315,768 | 4/1967 | Stuhler et al. | 92/9 |
| 3,850,078 | 11/1974 | Polizzi | 92/8 |
| 3,894,477 | 7/1975 | Tomikawa | 92/10 |
| 4,276,813 | 7/1981 | Weyman | 92/12 |
| 4,526,088 | 7/1985 | Reuschenbach et al. | 92/12 |

FOREIGN PATENT DOCUMENTS

| | | | |
|---|---|---|---|
| 2053819 | 7/1971 | Fed. Rep. of Germany | 92/12 |
| 3017403 | 11/1981 | Fed. Rep. of Germany | 92/12 |
| 819353 | 9/1959 | United Kingdom | 92/9 |
| 821319 | 10/1959 | United Kingdom | 92/12 |
| 1068197 | 5/1967 | United Kingdom | 92/12 |
| 1334630 | 10/1973 | United Kingdom | 92/12 |

OTHER PUBLICATIONS

*Progress Report: Conceptual Design & Analysis of a Novel Actuator*, by Everett, Jr. et al., Oct. 1988.

*Thesis: Modeling and Controll of a Novel Robotic Actuator*, by Ingram Dec. 1988.

*Primary Examiner*—Thomas E. Denion

*Attorney, Agent, or Firm*—Harvey Fendelman; Thomas Glenn Keough; Michael A. Kagan

[57] ABSTRACT

The present invention provides a pneumatically powered actuator having hydraulic control for both locking and controlling the velocity of an output rod without any sponginess. The invention includes a double-acting pneumatic actuator having a bore, a piston slidably engaged within the bore, and a control rod connected to the piston. The double-acting pneumatic actuator is mounted to a frame. A first double-acting hydraulic actuator having a bore, a piston slidably engaged within the bore, and a follower rod mounted to the piston is mounted to the frame such that the follower rod is fixedly connected to the control rod. The maximum translation of the piston within the bore of the first double-acting hydraulic actuator provides a volumetric displacement $V_1$. The present invention also includes a second double-acting hydraulic actuator having a bore, a piston slidably engaged within the bore, and an output rod mounted to the piston. The maximum translation of the piston within the bore of the second double-acting hydraulic actuator provides a volumetric displacement $V_2$, where $V_2 = V_1$. A pair of fluid ports in each of the first and second double-acting hydraulic cylinders are operably connected by fluid conduits, one of which includes a valve circuit which may be used to control the velocity of the output rod or to lock the output rod in a static position by regulating the flow of hydraulic fluid between the double-acting cylinders.

7 Claims, 3 Drawing Sheets

PNEUMATIC ACTUATOR WITH HYDRAULIC CONTROL

STATEMENT OF GOVERNMENT INTEREST

The invention described herein may be manufactured and used by or for the Government of the United States of America for governmental purposes without the payment of any royalties thereon or therefor.

This is a division of application Ser. No. 07/456,023 filed on Dec. 22, 1989, now U.S. Pat. No. 5,058,385.

BACKGROUND OF THE INVENTION

The present invention relates generally to the field of pneumatic actuators, and more specifically to pneumatically powered actuators having hydraulic actuation control.

Robotic applications have increased steadily with advancing technology. Installation of manipulators to automate assembly line tasks has become commonplace because of the increased productivity, reliability, and cost savings which can be realized through their use. The military is also interested in the application of robotics to missions where they may decrease risks to personnel and significantly enhance the probability of mission completion.

Manipulator actuators must generally satisfy a large number of functional criteria. Desirable qualities of a manipulator may include a high strength-to-weight ratio, high torque throughout translation, quick response to signal orders, smooth reversibility, high stiffness with low power consumption when idle, and positioning accuracy. Traditional choices for actuators are electric motors and either hydraulic or pneumatic actuators. Each of these have noted advantages and disadvantages.

Hydraulic actuators typically provide large force capability and significant power-to-weight ratios in fixed installations. They are suitable in applications requiring high force generation, stiffness, and precision control in tasks such as drilling or other machine tool operations. They are able to operate in dirty, abrasive, or wet environments and tolerate temperature extremes well. They may be safely used in explosive environments and generally provide a higher speed of response than electric motors. However, the disadvantages of hydraulic actuators include high cost due to the requirement for precision parts, contamination susceptibility, fluid leakage, and support components that are both bulky and heavy. Some operating fluids present a fire hazard.

Pneumatic actuators are primarily found in simple manipulation schemes. Typically, they provide uncontrolled motion between mechanical stop and are mainly used where point-to-point motion is required. They are simple to control and have relatively low operating costs. However, the compressibility of the actuating fluid eliminates any possibility of system stiffness. Pneumatic actuators, therefore, do not provide accurate position control between the limits of stroke.

Electric actuators are relatively low in cost and interface well with drive circuitry. They are used to power manipulators in low strength, precision applications such as in the manufacture of electronic circuit boards. They are easy to control, provide good torque, speed, and continuous power output performance, and operate quietly. However, their heavy power consumption makes them unsuitable for use in mobile applications where the energy usually is provided by onboard batteries. Unless electric actuators directly drive the manipulator joints, they must operate at high speed through long, backlash-prone gear trains. Furthermore, some sort of brake is required to hold position if power use is to be minimized, and for safety reasons in the event of a power failure. Electric actuators are usually not as rugged as hydraulic and pneumatic actuators and cannot operate in dirty, abrasive, wet, and corrosive environments unless they are sealed.

Performance requirements for a specific application can be difficult or impossible to achieve with conventional actuators from any single one of these categories. For example, one type of application may demand an actuator that is powerful, yet is light and rugged and which provides a well-controlled, precision actuation that can be locked at any intermediate position with no standby energy drain.

U.S. Pat. No. 3,779,135 by Sugimura, Dec. 18, 1973 discloses an air cylinder in which a piston rod and attached piston are reciprocated by air pressure alternately supplied to air chambers separated by the piston. A single-acting hydraulic cylinder is formed in a bore extending through the rod and piston of the air cylinder. This hydraulic cylinder has a hollow plunger secured at its one end to an end plate of the air cylinder. An inside bore of the plunger is communicated through a liquid conduit to an accumulator that includes a bladder precharged with a gas. An air valve controls the air supply to the air cylinder upon electrical actuation of left and right solenoids. A liquid valve is provided in the liquid conduit. The valve is opened during the time when its operating solenoid is energized and closed when the solenoid is deenergized. When the air valve is opened, the gas filled bladder introduces sponginess into the hydraulic system due to compressibility of the gas. Therefore, this mechanism is incapable of providing precise velocity control which is necessary for many robotic applications. In fact, this device is intended to only to provide a hydraulic braking to an air actuator. Therefore, there is a need for a pneumatically actuated cylinder which can provide positive braking as well as precision velocity control of the actuating link.

Accordingly, it is an object of the present invention to provide a pneumatic actuator having precision actuating rod velocity control without any sponginess. Another object of the present invention is to provide an a pneumatically powered actuator that can be positively locked in a given position. A further object of the present invention is to provide a hydraulically controlled pneumatic actuator that does not require an external accumulator.

SUMMARY OF THE INVENTION

The present invention overcomes the limitations of the prior art by providing a pneumatically powered actuator having hydraulic control for both locking and precisely controlling the velocity of an output rod. Because there is no gas interacting with the hydraulic circuit, the present invention provides velocity control without any lost motion. The invention includes a double-acting pneumatic actuator having a bore, a piston slidably engaged within the bore, and a control rod connected to the piston. The double-acting pneumatic actuator is mounted to a frame. A first double-acting hydraulic actuator having a bore, a piston slidably engaged within the bore, and a follower rod mounted to the piston, is mounted to the frame such that the follower rod is fixedly connected to the control rod. The maximum translation of the piston within the bore of the first double-acting hydraulic actuator provides a volumetric displacement $V_1$. The present invention also includes a second double-acting hydraulic actuator having a bore, a piston slidably engaged within the bore, and an output rod mounted to the piston. The maximum translation of the piston within the bore of the second double-acting hydraulic actuator provides a volumetric displacement $V_2$, where $V_2 \geqq V_1$. A pair of fluid ports in each of the first and second double-acting hydraulic cylinders are operably connected by fluid conduits, one of which includes a valve circuit which may be used to control the velocity of the output rod or to lock the output rod in a static position by regulating the flow of hydraulic fluid between the double-acting cylinders.

DESCRIPTION OF THE PREFERRED EMBODIMENT

Figure 1:
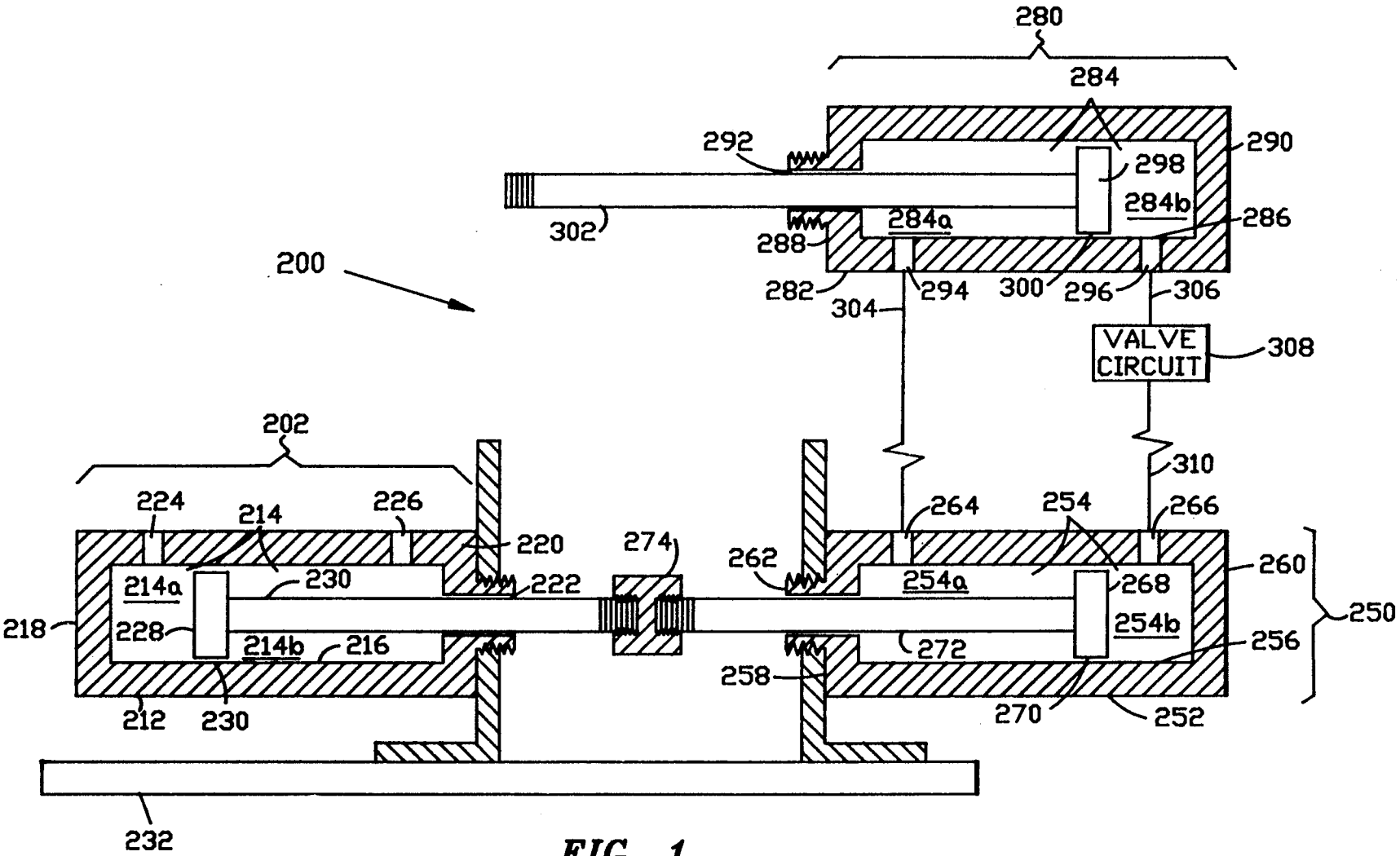
FIG. 1 is a sectional view of a first embodiment of a pneumatically actuated actuator having hydraulic actuation control.

A first embodiment of the present invention is illustrated in FIG. where there is illustrated pneumatically powered actuator 200 having hydraulic actuation control which includes double acting pneumatic cylinder 202 having cylindrical housing 212 with bore 214, bore surface 216, and end walls 218 and 220. End wall 220 includes bore 222. Gas ports 224 and 226, positioned towards each end of cylindrical housing 212 provide fluid communication between the exterior of cylindrical housing 212 and bore 214. Power piston 228 having circumferential surface 230 is slidably engaged within bore 214 so that the juxtaposition of circumferential surface 230 and bore surface 216 provides a sliding, fluid tight seal. The distance power piston 228 slides or translates within bore 214 ma be referred to as the "stroke" of pneumatic cylinder 202. Power piston 228 divides bore 214 into gas chambers 214*a* and 214*b*. Control rod 230, mounted to power piston 228, extends through bore 222 to the exterior of cylindrical housing 212. Cylindrical housing 212 is mounted to frame 232 by means well known to those of ordinary skill in this art.

Pneumatically powered actuator 200 also includes double acting hydraulic cylinder 250 having cylindrical housing 252 with bore 254, bore surface 256, and end walls 258 and 260. End wall 258 includes bore 262. Gas ports 264 and 266, positioned towards opposite ends of cylindrical housing 252 provide fluid communication between the exterior of cylindrical housing 252 and bore 254. Power control piston 268 having circumferential surface 270 is slidably engaged within bore 254 so that the juxtaposition of circumferential surface 270 and bore surface 256 provides a sliding, fluid tight seal. The distance power control piston 268 slides or translates within bore 254 may be referred to as the "stroke" of hydraulic cylinder 250. Power control piston 268 divides bore 254 into ga chambers 254*a* and 254*b* . Follower rod 272, mounted to power control piston 268, extends through bore 262 to the exterior of cylindrical housing 252. Cylindrical housing 250 is mounted to frame 232 by means well known to those of ordinary skill in this art. Control rod 230 of pneumatic cylinder 202 is fixedly coupled to follower rod 272 of hydraulic cylinder 250 with coupler 274 which may be threaded to rods 230 and 272.

In the preferred embodiment, rods 228 and 272 are coupled together so that the relative positions of power piston 228 and control piston 268 within bores 214 and 254, respectively, are established so that when power piston 228 is substantially adjacent end wall 220, control piston 268 is substantially adjacent end wall 260. This relationship is necessary so that pistons 228 and 268 may translate their full respective strokes. However, the scope of the invention includes coupling rods 228 and 272 with a linkage mechanism.

Pneumatically powered actuator 200 also includes double acting hydraulic cylinder 280 having cylindrical housing 282 with bore 284, bore surface 286, and end walls 288 and 290. End wall 288 includes bore 292. Gas ports 294 and 296, positioned towards opposite ends of cylindrical housing 282 provide fluid communication between the exterior of cylindrical housing 282 and bore 284. Power output piston 298 having circumferential surface 300 is slidably engaged within bore 284 so that the juxtaposition of circumferential surface 300 and bore surface 286 provides a sliding, fluid tight seal. The distance power output piston 298 slides or translates within bore 284 may be referred to as the "stroke" of hydraulic cylinder 280. Power output piston 298 divides bore 284 into gas chambers 284*a* and 284*b*. Output rod 302 is mounted to power output piston 298 and extends through bore 292 to the exterior of cylindrical housing 282. Fluid conduit 304 is operably coupled between port 294 of hydraulic cylinder 280 and port 264 of hydraulic cylinder 250. Port 296 of hydraulic cylinder 280 is connected in series with fluid conduit 306, valve circuit 308, fluid conduit 310 and port 266 of hydraulic cylinder 250. Valve circuit 308 may include an on/off valve, solenoid actuated on/off valve, throttling valve, servo valve, or any combination of valves.

Bores 254 and 284, fluid conduits 304, 306, and 310, and valve circuit 308 are filled with hydraulic fluid which then is purged of all entrained gas therein by a process known as "bleeding," which is well known by those skilled in this field of technology. A key feature of pneumatically powered actuator 200 is that the volumetric displacement of bore 254 is equal to the volumetric displacement of bore 284. Any hydraulic fluid displaced from bore 254 will be accumulated in bore 284. The benefit of this feature is that the hydraulic circuit of pneumatic actuator 100 has a high bulk modulus due to the virtual incompressibility of hydraulic fluid. This enables the actuation velocity of output rod 302 to be precisely controlled without any sponginess because there is no gas, which is inherently compressible, affecting on the hydraulic circuit.

In the operation of the invention, actuation of output rod 302 of hydraulic cylinder 280 occurs when pressurized gas is provided through port 224 into gas chamber 214*a* in cylindrical housing 212 while any gas within gas chamber 214*b* is simultaneously exhausted from gas chamber 214*b* through port 226. This process causes power piston 228 to translate towards end wall 220. Because control rod 230 is mounted to power piston 228, rods 230 and 272 translate likewise, causing control piston 268 to translate in the same direction as power piston 228. As control piston 268 translates, hydraulic fluid is forced out of hydraulic chamber 254*b* through hydraulic fluid port 266 into fluid conduit 310, through valve circuit 308, into fluid conduit 306, and then through port 296 into expanding fluid chamber 284*b*. The increasing volume of fluid chamber 284*b* forces follower output piston 298 to translate towards end wall 288 of hydraulic cylinder 280, causing output rod 302 to be extend further outwardly of cylindrical housing 282.

Retraction of control output rod 302 occurs when pressurized gas is provided through port 226 into gas chamber 214*b* of cylindrical housing 212 while any gas within gas chamber 214*a* is simultaneously exhausted through port 224. This process causes power piston 228 to translate towards end wall 218. Because control rod 230 is connected to power piston 228, and follower rod 272 is coupled to control rod 230, control piston 268 translates towards end wall 258, causing hydraulic fluid to be forced out of fluid chamber 254*a* through fluid port 264, fluid conduit 304, fluid port 294, and into expanding fluid chamber 284*a*. As fluid chamber 284*a* fills with hydraulic fluid, output piston 298 is forced to translate towards end wall 290, causing output rod 302 to retract inwardly into cylindrical housing 282.

Output rod 302 may be locked in any position by stopping the flow of hydraulic fluid between bores 284 and 254. This is accomplished by closing valve circuit 308. The velocity of actuation or retraction of output rod 302 may be precisely controlled if valve circuit 302 includes a throttling valve which may be unidirectional or bidirectional.

Figure 2:
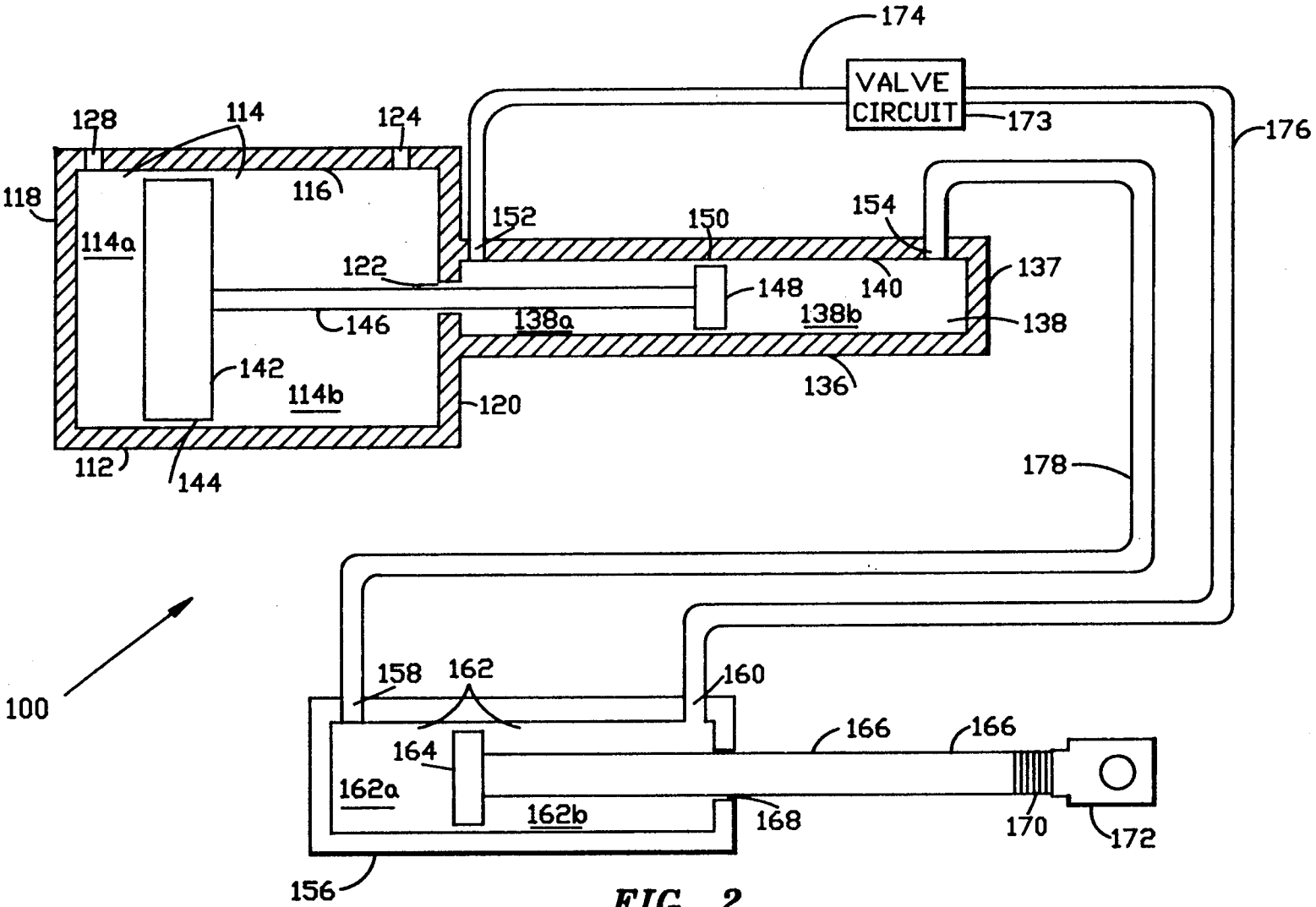
FIG. 2 is a sectional view of a second embodiment of a pneumatically actuated actuator having hydraulic actuation control.

A second embodiment of the present invention is illustrated in FIG. 2, where there is illustrated pneumatically powered actuator 100 which includes cylindrical housing 112 having bore 114, bore surface 116, and end walls 118 and 120. End wall 120 includes bore 122 and port 124. End wall 118 includes port 128. Bores 22 and 26 are coaxially aligned. Cylindrical housing 136 having end wall 137, bore 138, and interior bore surface 140, is mounted to end wall 120 such that bore 138 is coaxially aligned with bore 122. Cylindrical housing 136 also includes hydraulic fluid ports 152 and 152 positioned at opposite ends of housing 136. Piston 142 having circumferential surface 144 is slidably engaged in bore 114 so that the juxtaposition of circumferential surface 144 and bore surface 116 provides a sliding, gas-tight seal. Piston 142 divides bore 114 into gas chambers 114*a* and 114*b*. One end of rod 146 is mounted to piston 142 and extends through bore 122 of cylindrical housing 112 into bore 13 of cylindrical housing 136. The other end of rod 146 is mounted to piston 148 having circum-ferential surface 150.

Piston 148 is slidably engaged within bore 114 so that the juxtaposition of circumferential surface 150 and bore surface 140 provides a sliding, fluid-tight seal. Piston 148 divides bore 138 into fluid chambers 138*a* and 138*b*. The length of rod 146 is such that when piston 142 abuts the inside of end wall 120, piston 148 abuts the inside of end wall 137, and when piston 142 abuts the inside of end wall 118, piston 148 abuts end wall 120.

Pneumatically powered actuator 100 includes double acting hydraulic cylinder housing 156 having hydraulic fluid ports 158 and 160 positioned at opposite ends of cylinder housing 156. Cylinder housing 156 has bore 162 in which piston 164 is slidably engaged in fluid-tight engagement. Piston 164 divides bore 162 into fluid chambers 162*a* and 162*b*. Rod 166, mounted to piston 164, extends through bore 168 of cylinder housing 156. Outer end 170 of rod 166 may be threaded, as for example to receive clevis 172, shown in phantom.

Valve circuit 173, which may for example include an on/off valve, throttling valve, servo valve, or any combination of valves, is operably coupled between hydraulic fluid conduits 174 and 176 in order to provide fluid communication between hydraulic fluid ports 152 and 160. Hydraulic fluid conduit 178 is operably coupled between hydraulic fluid ports 154 and 158 to provide fluid communication therebetween.

Bores 138 and 162, hydraulic fluid conduits 174, 176, and 178, and valve circuit 173 are filled with hydraulic fluid and then purged of all entrained gas therein by a process known as "bleeding," as previously discussed herein. In the preferred embodiment, the volumetric displacement of bore 138 is equal to the volumetric displacement of bore 162. However, the invention would also work if the volumetric displacement of bores 138 and 162 are not equal. However, such an arrangement would be economically inefficient since one bore would be unnecessarily oversized with respect to the other since the output of rod 166 would be limited by the bore having the lesser volumetric displacement. This feature avoids the necessity of requiring an external hydraulic fluid accumulator to store any hydraulic fluid displaced from bore 138. The benefit of this feature is that the hydraulic circuit of pneumatically powered actuator 100 has a high bulk modulus due to the virtual incompressibility of hydraulic fluid.

Actuation of control rod 166 occurs when pressurized gas is provided through port 128 in end wall 118 of cylindrical housing 112 while any gas within gas chamber 114*b* is simultaneously exhausted through port 124. This process causes piston 142 to translate towards end wall 120. Because rod 146 is mounted to piston 142, rod 146 and piston 148 also translate in the same direction as piston 142. As piston 148 translates, hydraulic fluid is forced out of hydraulic chamber 138*b* through hydraulic fluid port 154, through port 158, and into expanding bore 158*a*, causing rod 166 to extend further out of cylinder housing 156.

Retraction of control rod 166 occurs when pressurized gas is provided through port 124 in end wall 120 of cylindrical housing 112 while any gas within gas chamber 114*a* is simultaneously exhausted through port 128. This process causes piston 142 to translate towards end wall 118. Because rod 146 is mounted to piston 142, rod 146 and piston 148 also translate in the same direction as piston 142. As piston 148 translates, hydraulic fluid is forced out of hydraulic chamber 138*a* through hydraulic fluid port 152, through port 160, and into expanding bore 162*b*, causing rod 166 to retract within cylinder housing 156.

Actuating rod 166 may be locked in any position by stopping the flow of hydraulic fluid between bores 138 and 162 hydraulic fluid conduits 174 and 176. This is accomplished by actuating valve circuit 173. The velocity of actuation or retraction of actuating rod 166 may be precisely controlled if valve circuit 173 includes a throttling valve which may be unidirectional or bidirectional.

Figure 3:
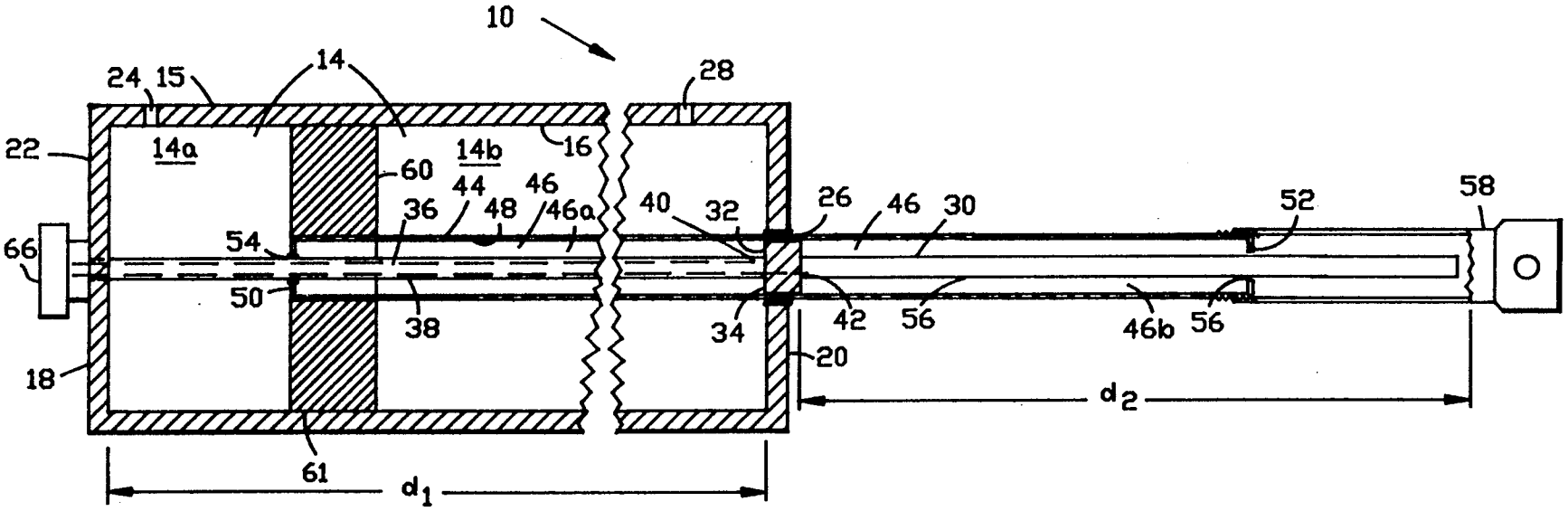
FIG. 3 is a sectional view of a third embodiment of a pneumatically actuated actuator having hydraulic actuation control.

A third embodiment of the present invention is illustrated in FIG. 3, where there is shown pneumatically powered actuator 10 which includes cylindrical housing 12 having bore 14, bore surface 16, and end walls 18 and 20. End wall 20 includes bore 22 and port 24. End wall 20 includes bore 26 and port 28. Bores 22 and 26 are coaxially aligned.

Rod 30 is fixedly secured through bore 22 to end wall 18 and extends through bore 26. Annularly shaped control piston 32 having bore 34 is fixedly secured to rod 30 such that control piston 32 is positioned substantially within the circumference of bore 26. Rod 30 includes hydraulic fluid conduits 36 and 38 which provide fluid communication from the exterior of cylindrical housing 12 to both sides of control piston 30 at hydraulic fluid ports 40 and 42, respectively.

Cylindrically shaped piston rod 44 having bore 46 with bore surface 48 includes end walls 50 and 52, each having coaxially aligned bores 54 and 56, respectively. Rod 30 extends through bores 54 and 56 so that piston rod 44 is slidably mounted around rod 30. The interface of bore surface 27 and the outer diameter of control piston 32 provides a sliding, fluid-tight seal that is accomplished by techniques well known to those skilled in this technology. Control piston 32 divides bore 46 into hydraulic fluid chambers **46*a* and 46*b*. The interface between the exterior surface of piston rod 44 and bore 26 provides a sliding, gas tight seal as would be well known to those of ordinary skill in this art. One end of rod 44 may be threaded to receive clevis 58**.

Power piston 60 is fixedly secured to one end of piston rod 44 and divides bore 14 of cylindrical housing 12 into separate gas chambers **14*a* and 14*b*. The interface between circumferential surface 61 of power piston 60 and bore surface 16** is a sliding, gas-tight seal that is obtained by techniques well known by those skilled in this technology.

Valve system 66, represented in block form in FIG. 3, is operably coupled in series between fluid conduits 36 and 38, and may for example, be mounted to end wall 18. Valve system 66 may, for example, include a servovalve, gate valve, a solenoid actuated on/off valve, a throttling valve, or any combination of valves suitable for controlling the flow of hydraulic fluid through hydraulic fluid conduits 36 and 38, as would be within the level of ordinary skill of one practicing in this art. Hydraulic fluid, not shown, purged of all gasses fills hydraulic fluid conduits 36 and 38, valve circuit 66, and chambers **46*a* and 46*b***.

To extend rod 25, pressurized gas, such as air or nitrogen, is provided through port 24 to expand chamber **14*a*, while the pressurized gas in chamber 14*b* is exhausted through port 28. Since rod 44 is fixedly secured to power piston 60, hydraulic fluid is forced from contracting chamber 46*a* through hydraulic fluid port 40, hydraulic fluid conduit 36, open valve circuit 66, hydraulic fluid conduit 38, and hydraulic fluid port 42, after which it enters expanding chamber 46*b*. This process continues until rod 44 reaches the end of its stroke, or until valve circuit 66 is closed. If valve circuit 66 is closed, rod 44 is locked in place due to the relative incompressibility of the hydraulic fluid. When retraction of rod 44 is desired, pressurized gas is exhausted from chamber 14*b* through port 24 while pressurized gas is introduced into chamber 14*b* through port 28, forcing power piston 60 and rod 44 to translate towards end wall 18. This motion causes the volume of chamber 46*b* to become smaller, thus forcing hydraulic fluid through port 42, back through hydraulic fluid conduit 38, valve circuit 66, hydraulic fluid conduit 36, and hydraulic fluid port 40, after which it 11 enters expanding chamber 46*a***.

If valve circuit 66 includes a throttling valve, the velocity of power piston 60 and actuation rod 44 can be very precisely controlled. Furthermore, rod 44 may be hydraulically locked in any intermediate position by closing valve circuit 66 due the relative incompressibility of hydraulic fluid.

An important feature of pneumatically powered actuator 10 is that any hydraulic fluid displaced from chamber **46*a* is forced into chamber 46*b*, and vice versa. This feature results from the fact that control piston 32 divides bore 46 into bores 46*a* and 46*b*, where the maximum volume of bore 46*a* is equal to the maximum volume of bore 46*b*. In other words, where rod 44 translates with respect to control piston 32, the maximum volumetric displacement of chamber 46*a* is equal to the maximum volumetric displacement of chamber 46*b* providing the benefit whereby the hydraulic fluid contained within pneumatically powered actuator 10 does not require storage in an accumulator. Thus, actuating rod 44 may extend its full stroke and the volume of hydraulic fluid displaced from chamber 46*a* will be transferred to chamber 46*b***, and vice versa.

The effective bulk modulus of elasticity of pneumatically powered actuator 10 is very high so that actuating rod 44 may be rigidly locked in any position without any accompanying sponginess.

Obviously, many modifications and variations of the present invention are possible in light of the above teachings. It is therefore to be understood that within the scope of the appended claims the invention may be practiced otherwise than as specifically described.

I claim:

1. A pneumatically powered actuator, comprising:

a first cylindrical housing having a first bore and an end wall, said end wall having a second bore therethrough, said first cylindrical housing having first and second fluid ports in fluid communication with said first bore, said first fluid port being at one end of said first cylindrical housing and said second fluid port being at the other end of said second cylindrical housing;

a power piston slidably mounted in said first bore;

a first rod having first and second ends, said first end mounted to said power piston, said second end extending through said second bore;

a control piston mounted to said second end of said first rod;

a second cylindrical housing having a third bore and an open end, said second cylindrical housing mounted to said first cylindrical housing such that said first rod extends into said third bore so that said control piston is slidably engaged within said third bore to provide a first volumetric displacement $V_1$, said second cylindrical housing having third and fourth fluid ports in fluid communication with said third bore, said third fluid port being at one end of said second cylindrical housing and said fourth fluid port being at the other end of said second cylindrical housing;

a double acting actuator including a housing having fifth and sixth fluid ports, a fourth bore in fluid communication with said fifth and sixth fluid ports, a piston slidably engaged in said fourth bore to provide a second volumetric displacement $V_2$, and an actuating rod mounted to said piston and extending through said housing, where $V_2=V_1$;

a first fluid conduit operably coupled between said fourth and fifth fluid ports to provide fluid communication between said double acting actuator and said third bore of said second cylindrical housing;

a second fluid conduit operably coupled to said third fluid port;

a third fluid conduit operably coupled to said sixth fluid port;

a valve circuit operably coupled to said second and third fluid conduits; and a volume of hydraulic fluid filling said third bore, said fourth bore, said first, second, and third fluid conduits, and said valve circuit.

2. The pneumatically powered actuator of claim 1, wherein said valve circuit includes:

a throttle valve.

3. The pneumatically powered actuator of claim 1 wherein said valve circuit includes:

a solenoid actuated on/off valve.

4. The pneumatically powered actuator of claim 1 wherein said valve circuit includes:

a throttle valve; and a solenoid actuated on/off valve in series with said throttle valve.

5. The pneumatically powered actuator of claim 1 wherein said valve circuit includes:

a servo-valve.

6. A pneumatically powered actuator system, comprising:

a first cylindrical housing having a first bore and an end wall, said end wall having a second bore therethrough, said first cylindrical housing having first and second fluid ports in fluid communication with said first bore, said first fluid port being at one end of said first cylindrical housing and said second fluid port being at the other end of said second cylindrical housing;

a power piston slidably mounted in said bore;

a first rod having first and second ends, said first end mounted to said power piston, said second end extending through said second bore;

a control piston mounted to said second end of said first rod;

a second cylindrical housing having a third bore and an open end, said second cylindrical housing mounted to said first cylindrical housing such that said first rod extends into said third bore so that said control piston is slidably engaged within said third bore to provide a first volumetric displacement, said second cylindrical housing having third and fourth fluid ports in fluid communication with said third bore, said third fluid port being at one end of said second cylindrical housing and said fourth fluid port being at the other end of said second cylindrical housing;

a double acting actuator including a housing having fifth and sixth fluid ports, a fourth bore in fluid communication with said fifth and sixth fluid ports, a piston slidably engaged in said fourth bore to provide a second volumetric displacement, and an actuating rod mounted to said piston and extending through said housing;

a first fluid conduit operably coupled between said fourth and fifth fluid ports to provide fluid communication between said double acting actuator and said third bore of said second cylindrical housing;

a second fluid conduit operably coupled to said third fluid port;

a third fluid conduit operably coupled to said sixth fluid port;

a valve circuit operably coupled to said second and third fluid conduits; and a volume of hydraulic fluid filling said third bore, said bore of said double acting actuator, said first, second, and third fluid conduits, and said value circuit.

7. The actuator system of claim 6 wherein said first volumetric displacement equals said second volumetric displacement.

* * * * *